US009004749B2

(12) United States Patent
Poffet et al.

(10) Patent No.: US 9,004,749 B2
(45) Date of Patent: Apr. 14, 2015

(54) OSCILLATING WEIGHT

(75) Inventors: Christian Poffet, Giffers (CH); Xavier Tinguely, Dombresson (CH); Andrés Cabezas Jurin, Yverdon-les-Bains (CH)

(73) Assignee: Eta sa Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 13/353,476

(22) Filed: Jan. 19, 2012

(65) Prior Publication Data

US 2012/0195173 A1 Aug. 2, 2012

(30) Foreign Application Priority Data

Jan. 27, 2011 (EP) ..... 11152381

(51) Int. Cl.
*G04B 5/02* (2006.01)
*G04B 5/16* (2006.01)

(52) U.S. Cl.
CPC ..... *G04B 5/165* (2013.01)

(58) Field of Classification Search
USPC ..... 368/207–208; 29/896.3
See application file for complete search history.

(56) References Cited

U.S. PATENT DOCUMENTS

| | | | | |
|---|---|---|---|---|
| 3,942,317 | A | 3/1976 | Schluep | |
| 7,785,212 | B2 * | 8/2010 | Lukasiewicz et al. | 473/332 |
| 8,236,410 | B2 * | 8/2012 | Shinoda et al. | 428/212 |
| 8,337,326 | B2 * | 12/2012 | Lukasiewicz et al. | 473/332 |
| 8,455,089 | B2 * | 6/2013 | Suzuki et al. | 428/297.4 |
| 2007/0140065 | A1 * | 6/2007 | Levingston | 368/127 |
| 2010/0029406 | A1 * | 2/2010 | Stites et al. | 473/334 |

FOREIGN PATENT DOCUMENTS

| | | | |
|---|---|---|---|
| CH | 249417 | A | 4/1948 |
| DE | 1 944 849 | A1 | 4/1970 |

OTHER PUBLICATIONS

Specific Gravity Wikipedia.org; Jul. 27, 2013.*

* cited by examiner

*Primary Examiner* — Sean Kayes
(74) *Attorney, Agent, or Firm* — Sughrue Mion, PLLC

(57) ABSTRACT

The oscillating weight for a self-winding watch mechanism is made by molding a plastic material charged with heavy metal particles. Moreover, the plastic material is also charged with fibers, wherein said fibers form between 1.5% and 7% of the total weight of the charged plastic material, and the density of the charged plastic material is greater than 8.

7 Claims, 1 Drawing Sheet

OSCILLATING WEIGHT

FIELD OF THE INVENTION

The present invention concerns oscillating weights for self-winding watches. The present invention more specifically concerns oscillating weights made of plastic or resin.

PRIOR ART

Watch parts which are made of plastic or synthetic resin are known. These parts may be made by moulding methods, which have the advantage of enabling various, sometimes very complicated shapes to be obtained without any correction operations. These parts also have the characteristic of having a density close to 1 and therefore of being light, which is most often an advantage.

However, it will be clear that the characteristic of lightness of the plastic parts may also be a serious drawback. This is the case in particular when the plastic part is intended to be used as an oscillating weight in a self-winding mechanism. Indeed, in a self-winding mechanism, the winding torque is proportional to the weight of the oscillating weight.

In order to overcome the aforementioned drawback, U.S. Pat. No. 3,942,317 proposes moulding parts having a density greater than 7. These parts are made from a mass of plastic material, in which a large quantity of heavy metal particles has been dispersed. The proposed method is particularly intended for making oscillating weights for self-winding watch mechanisms. It will be noted that, according to this prior art document, it is essential for the heavy metal content to be at least 99% pure. Moreover, it should not contain any carbon traces. Another drawback of the parts produced by this method is that they are brittle. Indeed, tests performed by the Applicant have shown that the oscillating weight tended to break when the watch was subjected to a shock.

BRIEF SUMMARY OF THE INVENTION

It is an object of the present invention to overcome the aforementioned drawbacks of the prior art. The present invention achieves this object by providing an oscillating weight for a self-winding watch mechanism in accordance with the annexed claim 1.

It should be specified here that the expression "heavy metal" means any metal whose density is greater than 11 and preferably greater than 17.

To form the oscillating weight according to the invention, the mixture formed by the plastic material and the charge thereof must be injected into a mould in a liquid state. Tests carried out by the Applicant demonstrated that the viscosity of the mixture to be injected greatly increased when fibres were added to the heavy metal. Moreover, beyond a certain concentration of fibres, the viscosity of the mixture became so high that the operation of injecting the mixture into a mould could no longer be performed normally. However, the Applicant discovered that, when the fibre concentration in the mixture is within a range of between 1.5% and 7% of the total weight, the mixture may be injected into the mould in a normal manner. Further, surprisingly, although the fibre concentration is relatively low, it is sufficient to provide the oscillating weight with good shock resistance.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF AN EMBODIMENT

To form an oscillating weight according to the present invention, a homogeneous mixture containing the plastic material, heavy metal and fibres must first be prepared. This mixture is in a liquid state. Advantageously, it is possible to use commercially available intermediate products to prepare the mixture.

For example, tungsten in the form of polyamide 12 granules (density of 1.02) charged with tungsten powder (density of 19.2) may be obtained. These granules are sold under the trademark Gravi-Tech® GRV-NJ-110-W by the PolyOne Corporation. The mixture forming the granules has a density of 11.0 and is suitable for injection moulding. Likewise, fibres mixed with polaymide 12 are sold, for example, by the EMS-GRIVORY company under the name Grilamid® TRVX-50X9 Natur. These are also granules. They are formed of approximately 50% (in volume) glass fibres, the remainder being polyamide 12.

The mixture according to the invention may be made by mixing Grilamid TR® and Gravi-Tech® fibres such that the Grilamid preferably makes up between 2.5% and 5% of the total weight of the mixture. The mixture of granules may either be used directly to feed the moulding tank of a conventional type of installation, or as raw material for making new granules incorporating the plastic material, the heavy metal and the fibres at the same time. In the latter case, the two types of granules can, for example, be introduced into an extruding machine, which will heat and mix the mixture, and then extrude the mixture under pressure in a sausage-shape which is cut into sections so as to provide new granules that can be directly used in a moulding apparatus. It is clear that the densities of the Grilamid TR® and Gravi-Tech® granules are very different. The Grilamid TR® granules thus tend to be concentrated in the top part of the mixture. It is therefore important to ensure that the mixture is satisfactorily homogeneous, so as to ensure good reproducibility of the moulded parts.

Figure 1:
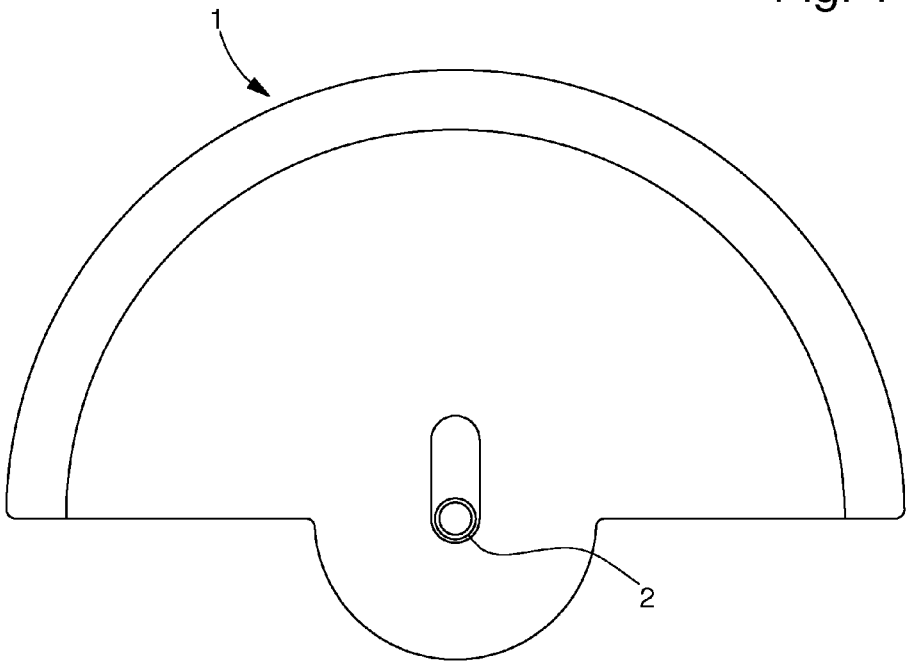
FIG. 1 is a plan top view of an oscillating weight for a winding mechanism according to a particular embodiment of the invention.
Figure 2:
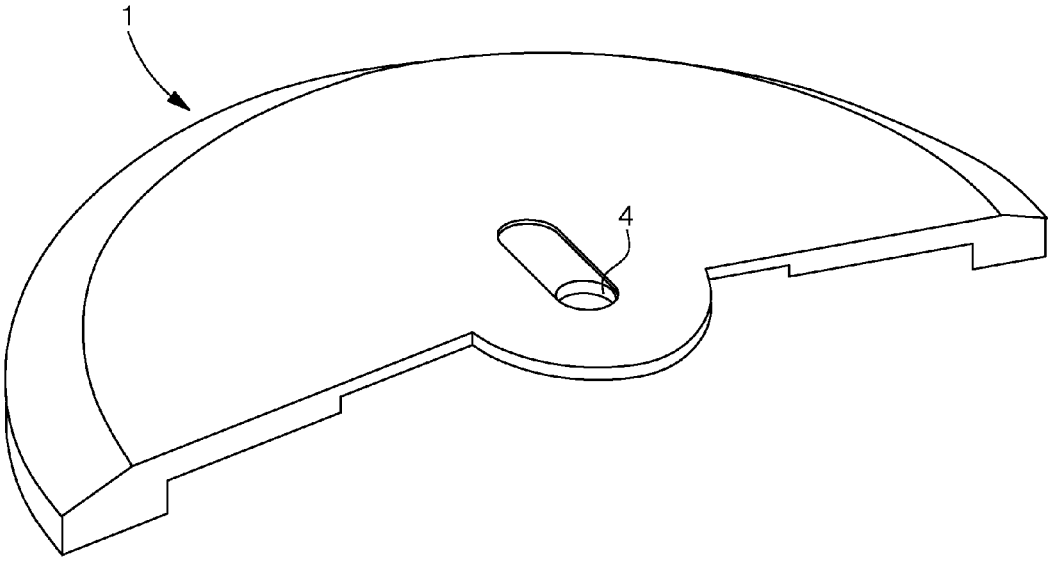
FIG. 2 is a perspective view of a variant of the oscillating weight of FIG. 1.

Injection moulding the plastic material charged with heavy metal and fibres allows oscillating weights of relatively complicated shapes to be produced in a single shaping operation, without requiring any correction or finishing operations. By way of example, injection moulding can produce the oscillating weight shown in FIG. 1 or 2. This "single piece" oscillating weight includes an oscillating sector 1, and a hub provided with a cylindrical bore 4 (FIG. 2) which is provided to allow the oscillating weight to pivot. These elements may be formed in a single injection moulding operation. Alternatively, hub 3 may be formed by a metal pipe 2 (FIG. 1) provided with a pinion (not shown) for transmitting the oscillating movements to the winding train (not shown), and onto which the oscillating weight is overmoulded.

It will also be clear that various alterations and/or improvements evident to those skilled in the art may be made to the embodiment described herein without departing from the scope of the present invention defined by the annexed claims. In particular, the heavy segment and plate of the oscillating weight could be made from two different plastic materials. The tungsten charged plastic material could, for example, be injected to form the heavy segment in a first operation. Next, the plastic material charged only with fibres could be injected in a second operation to form the plate of the oscillating weight. Furthermore, the invention is not limited to the use of the substances which are mentioned above by way of example. In particular, those skilled in the art will understand that a large number of plastic materials could be substituted for polyamide 12. In particular, thermoplastic materials or thermosetting resins could be used. Likewise, the tungsten could be replaced by gold, tantalum or any other heavy metal. Finally, the glass fibres could be replaced by carbon fibres or any other filling fibres known to those skilled in the art.

What is claimed is:

1. An oscillating weight for a self-winding watch mechanism formed by moulding a plastic material charged with heavy metal particles and with fibres, said fibres forming between 1.5% and 7% of the total weight of the thus charged plastic material, and the density of the charged plastic material being at least 8 times the density of water, wherein said fibres are selected from the group consisting of glass fibres and carbon fibres;

and said heavy metal is tungsten.

2. The oscillating weight according to claim 1, wherein said fibres form between 2% and 3.5% of the total weight of the charged plastic material.

3. The oscillating weight according to claim 1, wherein said fibres are glass fibres.

4. The oscillating weight according to claim 1, wherein said fibres are carbon fibres.

5. The oscillating weight according to claim 1, wherein said plastic material is polyamide.

6. The oscillating weight according to claim 5, wherein said polyamide is polyamide 12 (PA 12).

7. The oscillating weight according to claim 1, wherein a homogeneous mixture containing said plastic material, said heavy metal and said fibres is formed prior to the moulding.

* * * * *